United States Patent [19]

Hvizdos

[11] 4,271,676

[45] Jun. 9, 1981

[54] METHOD AND APPARATUS FOR RECOVERING NATURAL GAS IN A MINE

[75] Inventor: Leonard J. Hvizdos, Emmaus, Pa.

[73] Assignee: Air Products and Chemicals, Inc., Allentown, Pa.

[21] Appl. No.: 88,898

[22] Filed: Oct. 29, 1979

[51] Int. Cl.[3] ..... F17C 7/02

[52] U.S. Cl. ..... 62/55; 48/190; 48/DIG. 6; 166/267

[58] Field of Search ..... 166/267; 48/190, DIG. 6; 62/54, 55, 260, 514 R; 165/45

[56] References Cited

U.S. PATENT DOCUMENTS

| | | | |
|---|---|---|---|
| 1,418,097 | 5/1922 | Schneiders | 299/2 |
| 1,867,758 | 7/1932 | Ranney | 48/DIG. 6 |
| 3,400,547 | 9/1968 | Williams et al. | 62/55 |
| 3,770,398 | 11/1973 | Abraham et al. | 166/267 |
| 4,043,395 | 8/1977 | Every et al. | 48/DIG. 6 |
| 4,206,610 | 6/1980 | Santhanam | 62/55 |
| 4,213,476 | 7/1980 | Bresie et al. | 62/55 |

*Primary Examiner*—Ronald C. Capossela

*Attorney, Agent, or Firm*—Douglas G. Glantz; James C. Simmons; E. Eugene Innis

[57] ABSTRACT

Method and apparatus are disclosed for the recovery and removal of natural gas from a mine by liquefying and collecting the gas within the mine, and then transporting the liquified gas to the surface in a mobile tank. Natural gas is withdrawn from bore holes in a coal mine and liquefied using liquid nitrogen. A unique apparatus permits both the liquid nitrogen and the liquefied natural gas to be contained within a same insulated tank, enhancing the portable characteristics. Liquid nitrogen and its vapor are used to cool the natural gas so as to separate water and $CO_2$. Means are disclosed for controlling the cooling by the cryogenic liquid by regulating the venting flow rate of its vapor in response to the pressure of the liquefied natural gas. The disclosed system eliminates the need for extensive piping and on-site pumping associated with conventional degasification processes.

6 Claims, 1 Drawing Figure

METHOD AND APPARATUS FOR RECOVERING NATURAL GAS IN A MINE

This invention relates to degasifying coal and other carbonaceous materials in a subterranean mine, and more particularly to the recovery and removal of methane and natural mine gases from coal seams before the coal is mined.

BACKGROUND AND PRIOR ART

Prior to this invention, processes for degasifying coal have been limited by the need for extensive piping systems from an underground mine face to the surface. For example, Ranney, U.S. Pat. No. 1,867,758, shows a process for degasifying coal which requires piping and possible pumping to convey gas to the surface from horizontal and vertical bore holes in a coal mine.

Schneiders, U.S. Pat. No. 1,418,097, shows a process for pumping oil and gas to the surface of a mine from horizontal or slanting bore holes, and Byers, U.S. Pat. No. 12,928, shows a method for collecting only dust and solid particles by a gravity settling process and exhausting the gases which are also collected.

A study contract performed by Arthur D. Little, Inc., Cambridge, Massachusetts, for the U.S. Bureau of Mines, "Economic Feasibility of Recovering and Utilizing Methane Emitted from Coal," (Apr. 15, 1975) reports on methods for drilling bore holes in a mine for draining methane and discusses piping the recovered methane to the surface.

Bureau of Mines publication No. RI-8173, entitled "Degasification and Production of Natural Gas From an Air Shaft in the Pittsburgh Coal Bed," by Fields et al (1976), indicates the problems associated with the use of underground pipelines in mines to transport methane out of the mine, e.g., leakage caused by improper installation or alignment of the pipeline. The Bureau of Mines report discloses the use of a water gas separator having a receiver for the water and piping the separated gas to the surface.

An article appearing in the periodical *A.G.A. Monthly* entitled, "Degasification of Coal Beds—A commercial Source of Pipeline Gas" (May, 1976) by M. Deul indicates that productivity from "gob" degasification holes does not justify a permanent surface installation, but that "the use of portable gas turbines or gas liquefaction concentrators to conserve the gas is worth investigating." (*A.G.A. Monthly*/May, 1976 at page 8.)

It is an object of this invention to provide a method and means for recovering and removing methane and minor other portions of hydrocarbon gases at or near the coal face in a subterranean mine before the coal is mined and for eliminating the piping and pumping requirements of conventional degasifying systems.

A further object of this invention is to provide a method and apparatus for reducing hazardous and noxious mine gases in the mine, thereby eliminating the need for piping and pumping larger volumes of ventilation air to dilute these dangerous gases at the subterranean coal face.

SUMMARY OF THE INVENTION

The above objects are achieved and other problems of the prior art methods of mine gas removal are overcome by this invention which comprises the recovery and removal of a hydrocarbon gas in a subterranean mine by liquefying the gas and transporting the liquefied gas in a vessel from a position at or near the mine face. The liquefaction is effected by cooling the mine gas by indirect heat exchange communication with a cryogenic liquid, such as liquid nitrogen (LIN), and with the vapor from the cryogenic liquid. The liquefied hydrocarbon gas, which can be methane or natural gas (LNG), is collected in a transportable tank having sufficient insulation to prevent undue heat leak, and preferably contained within the cryogenic liquid nitrogen storage tank. The portable tank can be moved from place to place so as to collect the mine gas at selected locations at or near the mine face and also to transport the liquefied mine gas out of the subterranean mine.

In one aspect of the invention the cooling in heat exchange communication with the cryogenic liquid and vapor from the cryogenic liquid is controlled by regulating the flow rate of the vapor from the cooling liquid in response to the pressure of the liquefied hydrocarbon gas collected in the portable tank. A further refinement of this invention includes a series of separation zones wherein water and carbon dioxide are separated from the hydrocarbon gas to be liquefied, by gravity water separation, water-condensing separation, water-freezing separation and $CO_2$-freezing separation. These condensing and freezing separation methods can be effected by cooling using the vapor from the cryogenic liquid used to liquefy the hydrocarbon gas. Further aspects of this invention will become obvious from an inspection of the illustrative embodiment appearing in FIG. 1 and the following description and claims.

IN THE DRAWING

FIG. 1 is a schematic diagram showing a process for recovering and removing hydrocarbon gas in a mine by liquefying according to this invention, and also illustrating a transportable apparatus which can be used for liquefying and collecting the hydrocarbon gas in the mine.

DESCRIPTION OF THE PREFERRED EMBODIMENTS

Figure 1:
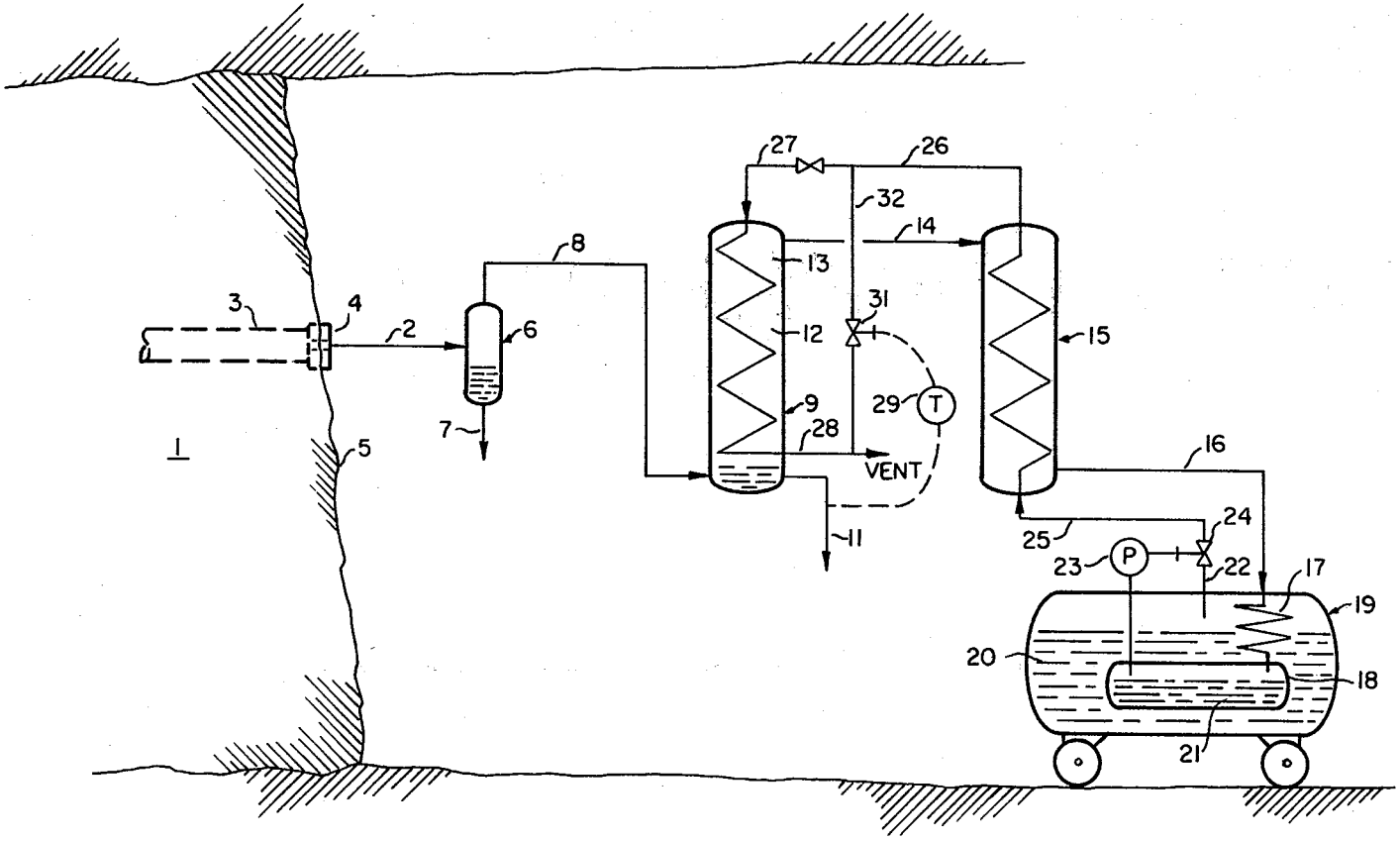

Referring to FIG. 1, gases occurring naturally in the coal, including primarily methane, are collected from the coal seam 1 by well known techniques and are withdrawn in line 2 from a degasification bore hole 3 (or holes) in coal seam 1. The bore hole or holes can be prepared by inserting a plug 4 into the coal face 5 at the end of a working shift in sufficient number to prepare for drilling bore holes of sufficient number to degasify the coal bed during the period when the mine face would normally not be worked. Tubing, as indicated by line 2, is connected to the plugs which are sealed into the coal to prevent gas leaks either into or out of line 2.

The collected gases are withdrawn from the coal seam and passed through line 2 to phase separator 6 where any liquid water is separated out in line 7. The vapor overhead from separator 6 is then directed in line 8 to heat exchanger 9 where the gas is cooled from the coal bed temperature to a temperature which condenses a large part of the water from the gas stream. Exchanger 9 is designed such that the flow of wet gas is upward so that as the gas is cooled in a first lower portion of exchanger 9, water condenses and is drained from the exchanger in line 11. The gas is further cooled in exchanger 9 in a middle portion 12 to a temperature at which most of the water condenses out. As the gas passes to an upper portion 13, it is cooled further such that ice freezes out on the heat exchange surfaces of exchanger 9. Preferably the gas stream is further cooled to about −130° F. or below before leaving exchanger 9 in line 14. At this point essentially all of the water in the initial gas stream has been removed from the gas.

The gas from exchanger 9 is passed in line 14 to exchanger 15 where the gas is cooled to a temperature sufficient to freeze any carbon dioxide on the heat exchanger surfaces of exchanger 15. Under the conditions given in this example the carbon dioxide begins to freeze out at about −150° F., but it is preferable to cool the gas to a lower temperature and thereby enhance the downstream liquefaction of the methane.

The exit stream from exchanger 15 is passed in line 16 to the LNG storage tank 18, through line 17 in heat exchange relationship with the nitrogen gas and LIN 20 in an insulated refrigeration storage tank 19. Gas in line 17 is cooled and finally totally liquified and collected as liquid 21 in LNG tank 18 (located within LIN tank 19) by heat exchange against boiling nitrogen in LIN tank 19.

The cooling required in exchangers 15 and 9 is supplied by the cold nitrogen vapor from tank 19 passing through lines 22,25 and 26,27 to exchangers 15 and 9, respectively. The rate of condensation og gas into liquid at 21 is controlled by a pressure indicator controller 23 operatively connected to valve 24 in line 22. Controller 23 raises or lowers the pressure of the boiling nitrogen in apparatus 19 by closing down or opening valve 24 as a function of the pressure sensed inside the LNG tank 18. When the LNG tank pressure tends higher than the set point, the pressure controller opens valve 24 to lower the pressure in the LIN tank 19, thereby effecting increased evaporative cooling inside the LIN tank 19. The increased cooling in the LIN tank operates through the heat exchange communication to condense out LNG from the high pressure methane in the LNG tank 18. The act of opening valve 24 in the LIN tank exit line 22 also operates to increase the flow rate of cold $N_2$ vapor to heat exchangers 15 and 9 and thereby further cool the methane stream, further enhancing the downstream liquefaction.

For the example given here, the pressure inside the LNG tank 18 is set at 14.00 psia. The pressure of the boiling nitrogen inside tank 19 depends on the efficiency of the heat transfer through the surface of line 17 in tank 19 and through the surface of LNG tank 18 in contact with liquid nitrogen in LIN tank 19.

Exchangers 9 and 15 periodically require defrosting which can be accomplished either by having two sets of exchangers in parallel so that one set is being defrosted while another is on stream or by only defrosting during down time periods when transportable tank 19 is outside the mine. Defrost purge gas can be taken either from the warm vaporized nitrogen or from another suitable source outside the mine.

The invention includes a further embodiment in regulating the cool nitrogen vapor stream entering the water condensing separation zone of heat exchanger 9, in response to and so as to maintain a desired temperature of the effluent water temperature of stream 11, for example, at or about 33° F., and thereby control the operation of the water condensing unit. The vapor stream through exchanger 9 exiting via line 28 is controlled by a temperature control regulator 29 operatively connected to valve 31 in bypass line 32. This control scheme permits a regulation of the cold vapor stream passing into heat exchanger 9 while permitting the vapor stream released from LIN tank 19 into exchanger 15 to flow independently. In this way excessive freezing of water in heat exchanger 9 is avoided. LIN tank 19 and optionally exchangers 9 and 15 are provided with means for transporting the entire assembly out of the mine, such as by wheels for traveling on rails or graded surfaces.

This invention provides a method and apparatus to degasify coal before mining at the mine face, to convert it to a liquid, and to transport the liquefied mine gas out of the mine without the need for conventional piping systems which are not used extensively in this country because of cost and safety problems. By replacing piping in mines, this invention is cheaper to build and safer to operate. The invention eliminates current requirements for pumps or compressors and the attendant capital and operating costs including power and maintenance, needed at the mine to remove the mine gases in the conventional processes having extensive piping networks. The invention also eliminates problems such as leakage of gas from the extensive piping networks caused by improper installation or faulty alignment of the pipes, often associated with conventional processes.

The amount of ventilation air used to dilute the dangerous mine gases can be substantially reduced with this invention since the methane in the coal is degassed and removed from the mine before the coal is mined.

The invention also is a convenient means for handling variable flows of draining mine gas and does not require gas compressors and large gas piping systems with excess capacity needed for peak flows of degassed methane.

The liquefied natural gas is available at the mine surface for mine use, for transport to nearby industry for storage and use at steady and controlled rates, or for pipeline sale upon vaporization. When the liquefied natural gas is vaporized, the refrigeration in the liquefied natural gas also can be used to help liquefy the required liquid nitrogen and reduce the cost of operation.

After the liquefied natural gas is vaporized and dispensed at the user site, the portable tank may be moved to a liquid nitrogen filling station, such as at an air separation facility, a large LIN storage tank, or a LIN tank truck, for the purpose of receiving a full charge of LIN. The portable tank filled with LIN then can be moved to the selected mine face for degasification purposes.

ILLUSTRATIVE EXAMPLE 1

Mine gas at 18 psia and 55° F., having an initial composition shown as (1) in Table 1, is withdrawn from a coal seam in the Pittsburgh coal bed and is passed through a gravity separator to remove entrained water droplets. The remaining liquid water in the gas from the separator is removed in a condenser and freezer cooled by the $N_2$ vapor from the downstream liquefaction process. Dry gas, shown as (2) in Table 1, from the $H_2O$ freezer at about −130° F. is passed first to an exchanger where $CO_2$ is frozen out of the gas. The essentially $CO_2$-free gas is passed to the liquefaction apparatus. Heat is removed from the gas in the $CO_2$ separator and indirectly exchanged with cold $N_2$ vapor from the liquefaction apparatus sufficiently to lower the temperature of the hydrocarbon gas and freeze out the $CO_2$. The hydrocarbon gas, shown as (3) in Table 1, is liquified in the liquefaction apparatus by indirect heat exchange with liquid nitrogen (LIN) and its vapor. The liquefied natural gas (LNG) at a temperature of about −263° F. is accumulated, shown as (4) in Table 1, in a vessel located within the LIN storage tank which is at a temperature of about −270° F. and pressure of about 160 psia. Lower temperatures in the LIN tank are produced by lowering the pressure therein. Lower temperatures in the LIN tank are periodically necessary to maintain the LNG in liquefied condition and are effected by lowering the pressure in the LIN tank in response to an increasing pressure in the LNG tank beyond a specified limit. The specified limit in this example is 14.00 psia. Table 1 shows compositions, temperatures, pressures and flow rates.

EXAMPLE 2

Mine gas having composition shown in (1) Table 2 is withdrawn from a coal seam in the Sunnyside Coalbed, Utah, and processed in the same method used in Example 1. Table 2 shows compositions, temperatures, pressures and flow rates at the same process stages employed in Example 1.

TABLE 1

| | (1) Initial Composition | (2) Dry Gas leaving $H_2O$ Separators | (3) Hydrocarbon Gas leaving $CO_2$ Separator | (4) Product Composition in LNG Tank |
|---|---|---|---|---|
| Pressure psia | 18. | 16. | 15.0 | 14.0 |
| Temperature °F. | 55. | −130. | −243.0 | −262.74 |
| Composition Mole % | | | | |
| Water | 55.84 | 0.0 | 0.0 | 0.0 |
| Carbon Dioxide | 4.73 | 10.69 | 0.0 | 0.0 |
| Methane | 39.16 | 88.69 | 99.31 | 99.31 |
| Ethane | 0.02 | 0.05 | 0.06 | 0.06 |
| Nitrogen | 0.20 | 0.45 | 0.50 | 0.05 |
| Oxygen | 0.05 | 0.12 | 0.13 | 0.13 |
| Vapor Lb. Moles/Hr | 2.23 | 2.20 | 1.96 | 0.0 |
| Liquid Lb. Moles/Hr | 2.75 | 0.0 | 0.0 | 1.96 |
| Total Flow Lb. Moles/Hr | 50.00 | 2.20 | 1.96 | 1.96 |

TABLE 2

| | (1) Initial Composition | (2) Dry Gas leaving $H_2O$ Separators | (3) Hydrocarbon Gas leaving $CO_2$ Separator | (4) Product Composition in LNG Tank |
|---|---|---|---|---|
| Pressure psia | 18. | 16.0 | 15.0 | 14.0 |
| Temperature °F. | 55. | −130. | −217.0 | −262.4 |
| Composition Mole % | | | | |
| Water | 11.22 | 0.0 | 0.0 | 0.0 |
| Carbon Dioxide | trace | trace | 0.0 | 0.0 |
| Methane | 88.08 | 99.22 | 99.22 | 99.22 |
| Ethane | 0.16 | 0.18 | 0.18 | 0.18 |
| Propane | 0.03 | 0.03 | 0.03 | 0.03 |
| Nitrogen | 0.40 | 0.45 | 0.45 | 0.45 |
| Oxygen | 0.11 | 0.12 | 0.12 | 0.12 |
| Vapor Lb. Moles/Hr | 2.23 | 2.20 | 2.20 | 0.0 |
| Liquid Lb. Moles/Hr | 0.25 | 0.0 | 0.0 | 2.20 |
| Total Flow Moles/Hr | 2.48 | 2.20 | 2.20 | 2.20 |

What is claimed is:

1. A method of recovering a hydrocarbon gas in a subterranean mine comprising:
   (a) accumulating said hydrocarbon gas in a collection zone in said mine,
   (b) withdrawing said hydrocarbon gas from said collection zone to form a gas stream,
   (c) passing said stream in indirect heat exchange with cryogenic fluid selected from cryogenic liquid and vapor from cryogenic liquid to liquefy said hydrocarbon gas and form liquefied hydrocarbon gas,
   (d) accumulating said liquefied hydrocarbon gas in a transportable vessel, and
   (e) transporting said liquefied hydrocarbon gas out of said mine in said transportable vessel.

2. A method according to claim 1 wherein said liquefying by said heat exchange comprises storing said cryogenic fluid in a first storage zone encompassing said transportable vessel, and passing said hydrocarbon gas stream through said first storage zone to a second storage zone within said transportable vessel wherein said liquefied hydrocarbon gas is accumulated.

3. A method according to claim 2 wherein water and carbon dioxide are separated from said gas by passing said gas stream through a water-condensing separation zone, a water-freezing separation zone, and a $CO_2$-freezing separation zone in indirect heat exchange with at least a portion of said vapor from said cryogenic liquid.

4. A method according to claim 3 wherein said liquefying by said heat exchange with said vapor from said cryogenic liquid further comprises controlling said liquefying by regulating the flow rate of said vapor from said cryogenic liquid in response to the pressure of said hydrocarbon gas in said second storage zone within said transportable vessel, whereby an increasing pressure in said hydrocarbon gas in said second storage zone operates to increase said flow rate and thereby increase said liquefying.

5. A method according to claim 4 wherein said water separation in said water-condensing separation zone by said heat exchange with said vapor from said cryogenic liquid further comprises a controlled cooling of said water-condensing separation zone by regulating the flow rate of a second portion of said vapor bypassing said water-condensing separation zone in response to the temperature of said water-condensing separation zone.

6. A method according to claim 2, claim 3, or claim 5 wherein said hydrocarbon gas comprises natural gas, and said cryogenic liquid comprises liquid nitrogen.

* * * * *